United States Patent [19]

Pritchard

[11] Patent Number: 4,729,270

[45] Date of Patent: Mar. 8, 1988

[54] SOCKET DRIVER SPANNER

[76] Inventor: Norman L. Pritchard, 37 Surrey Street, Minto, New South Wales, Australia, 2566

[21] Appl. No.: 10,555

[22] Filed: Feb. 3, 1987

[30] Foreign Application Priority Data

Feb. 4, 1986 [AU] Australia ..... PH4436

[51] Int. Cl.[4] ..... B25B 13/00

[52] U.S. Cl. ..... 81/57.43; 81/177.5; 81/58.1

[58] Field of Search ..... 81/57.43, 57.42, 54, 81/177.5, 177.2, 58, 58.1, 58.2, 58.3, 58.4, 58.5

[56] References Cited

U.S. PATENT DOCUMENTS 3,572,188 3/1971 Christian ..... 81/58.1

FOREIGN PATENT DOCUMENTS 528095 10/1940 United Kingdom ..... 81/58.1

*Primary Examiner*—Frederick R. Schmidt
*Assistant Examiner*—Maurina Rachuba
*Attorney, Agent, or Firm*—Wegner & Bretschneider

[57] ABSTRACT

A socket drive spanner having an outer tube and a conventional half inch square driver protruding therefrom. A spindle and an inner tube are located within the outer tube and the spindle is rotated by axially moving a rod which is perpendicular to the outer tube. The rod has a cable pulley system which wraps around the spindle, thereby rotating it, the inner tube the spindle and the half inch square driver are engaged together and rotate in unison. When the half inch square driver is disengaged from the inner tube, and locked into place the half-inch square driver is then stationary with respect to the outer tube and hence the spanner can then be used in a conventional manner.

10 Claims, 2 Drawing Figures

SOCKET DRIVER SPANNER

The present invention relates to socket driver spanners and in particular, to a socket driver spanner which enables the user ease of operation.

BACKGROUND OF THE INVENTION

Prior art socket driver spanners include spanners which have ratchets connectable to their shafts. The ratchet is connected such that the shaft turns freely in one rotational direction whilst in the other rotational direction the shaft rotates the nut or bolt which is to be turned.

The use of the ratchet spanner enables the user to turn nuts or bolts when the space for the rotation of a conventional spanner is restricted. The ratchet spanner also enables ease of operation as the socket does not have to be removed from the nut or bolt during its tightening or loosening. This saves time if there are a lot of nuts and bolts to be tightened and/or loosened.

Another form of driver spanner utilizes an air gun. However, this is relatively costly and can sometimes if not used correctly strip threads of bolts or studs.

SUMMARY OF THE INVENTION

It is an object of the present invention to provide an improved socket driver spanner which can be used in a restricted space and which provides a quicker operation to remove or replace a nut or bolt.

According to one aspect of the present invention there is disclosed a socket drive spanner having a first rigid tube, a second rigid tube co-axially received within one end of said first tube and having an inner end and an outer end, a socket driver means partially received within the outer end of said second tube for rotation therewith, a spindle co-axially received within said first tube and having one end partially received within the inner end of said second tube, to permit sliding engagement but prevent rotation therebetween, and said one end of said first tube being slidably engageable with said socket driver means to prevent rotation therebetween, wherein said spindle, said second tube and said socket driver means are rotatable in unison relative to said first tube only when said socket driver means is slidably dis-engaged from said one end of said first tube.

One embodiment of the present invention will now be described with reference to the drawings in which:

DETAILED DESCRIPTION OF THE EMBODIMENT

Figure 1:
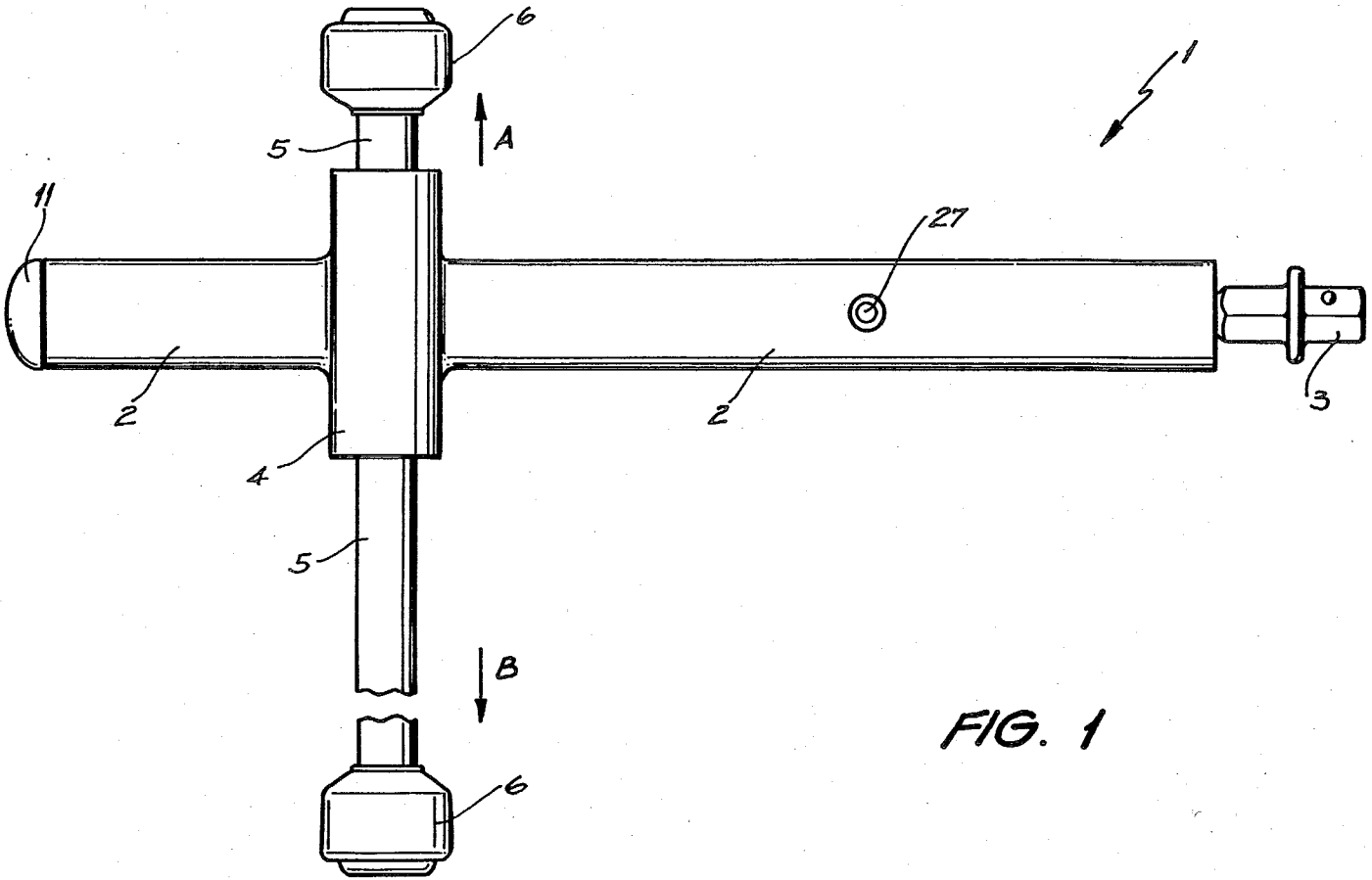
FIG. 1 is a longitudinal side elevation of the socket drive spanner of the preferred embodiment.
Figure 2:
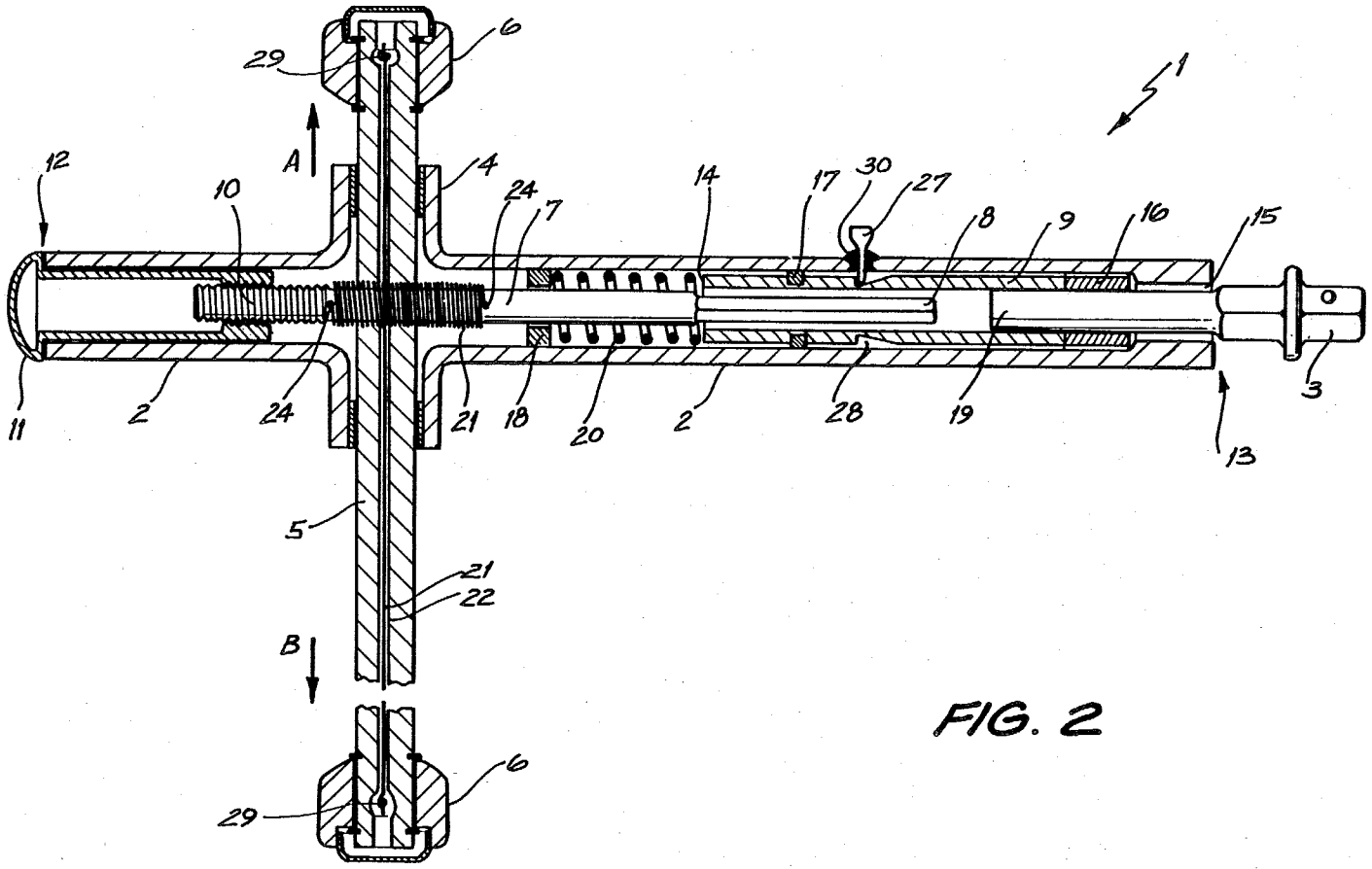
FIG. 2 is a longitudinal cross section through the socket drive spanner of FIG. 1.

The socket driver spanner 1 of the preferred embodiment comprises an outer tube 2, a substantially conventional half inch square driver 3, a T-joint 4 and a rod 5 having a nob 6 at both ends. The rod 5 is free to move axially, and thus perpendicularly to the outer tube 2.

Inside the outer tube 2 is a round spindle 7 which at one end 8 has a square cross section. This end 8 fits into an inner tube 9, whilst at the other end 10 the spindle is threaded and is received into a threaded cap 11 which fits in one end 12 of the outer tube 2.

The inner tube 9 is rotatably received at the other end 13 of the outer tube 2. The inner tube 9 has a generally circular cross section except at its inner end 14 which has an inner surface of square cross section to slidingly mate with the square cross section end 8 of the spindle 7.

The inner tube 9 is kept in position by a bush 16. The bush 16 is a press fit with the round end 19 of the half inch square driver 3. A slip clutch situated at inner end 14 assists the even rotation of the inner tube 9 and also will release when there is too much stress applied to the spindle 7 and inner tube 9 during rotation.

The open end 15 of the outer tube 2 has an inner peripheral surface having an internal square cross section so that the external square cross section of the half inch square driver 3 can be slidingly mated within the open end 15. A spring 20 and a collar 18 restrict the axial movement of the inner tube 9 when the half inch square driver 3 is pushed into the end 15 of the outer tube 2. A locking device 27 locks the inner tube 9 into position against the bias of the spring 20. The locking device consists of a round aperture in the outer tube 2 into which a pin is insertable, and a rubber grommet 30 seals the aperture and holds the pin of the device 27 in place.

The rod 5 is substantially perpendicular to the spindle 7 and has two cables 21 which run along the length of a slot 22 which is cut into the rod 5. The cables 21 are anchored at both ends 29 of the rod 5 and to the spindle 7 at two points 24. As the rod 5 moves in either direction A or B, the cables 21 simultaneously twist around the spindle 7 thus rotating the spindle 7 in the desired direction.

To operate the spanner 1, the half inch square drive 3 is connected into a conventional socket spanner (not illustrated). The spanner engages the nut or bolt to be tightened or loosened. The half inch square driver 3 is pushed against the urging of the spring 20 into the end 15 of the outer tube 2. This position is locked by the locking device 24, and as both the half inch square driver 3 and the end 15 have square cross sections, the rotation of the spindle 7 inside the outer tube 2, is also locked. The nut or bolt is loosened by turning the outer tube 2 using the rod 5 as a lever arm when in this locked position.

Once loosened, the half inch square driver 3 can be released by locking device 24 from within the outer tube 2. Then by moving the rod 5 in either direction A or B the spindle 7, and hence also the inner tube 9 and half inch square driver 3, rotate so that the nut or bolt is also rotated.

The slip clutch at inner end 14 operates in such a way that if the bolt being either tightened or loosened resists the turning torque, the slip clutch at inner end 14 releases the spindle 7 from the inner tube 9 thus releasing the torque and preventing any damage from occuring.

When the nut is to be tightened, the half inch square driver 3 can be locked back into the outer tube 2 so that a greater force can be used to tighten the nut or bolt.

The foregoing describes one embodiment of the present invention and modifications, obvious to those skilled in the art can be made thereto without departing from the scope of the present invention.

What I claim is:

1. A socket drive spanner having a first rigid tube, a second rigid tube co-axially received within one end of said first tube and having an inner end and an outer end, a socket driver means partially received within the outer end of said second tube for rotation therewith, a spindle co-axially received within said first tube and having one inner end partially received within the inner end of said second tube, to permit sliding engagement but prevent rotation therebetween, and said one end of said first tube being slidably engageable with said socket driver means to prevent rotation therebetween, wherein said spindle, said second tube and said socket driver means are rotatable in unison relative to said first tube only when said socket driver means is slidably disengaged from one end of said first tube.

2. The spanner as claimed in claim 1, wherein the inner end of said spindle has a polygonal cross-section mating substantially in a sliding engagement with part of inner surface of said second tube, the outer end of said spindle being rotated by a drive means.

3. The spanner as claimed in claim 2, wherein the outer end of said spindle is threaded and is received into a threaded insert located within a second end of said first tube, said drive means comprising a rod pulley system consisting of a rod substantially perpendicular to said first tube, said rod reciprocally located in a T-joint in said first tube and having two cables which twist around said spindle, and as said rod is moved axially and reciprocally said cables rotate said spindle.

4. The spanner as claimed in claim 1 wherein said second tube abuts at its inner end a spring means which in turn abuts a first stop means, and at its outer end abuts a second stop means whereby said inner tube is able to be pushed by the socket driver means against the urging of said spring means whereby said socket driver means is slidably engaged with one end of said first tube, and a locking device locks said inner tube and said socket drive means together.

5. The spanner is claimed in claim 1 wherein said second tube has a slip clutch which engages with said spindle to allow relative rotational movement therebetween.

6. The spanner as claimed in claim 2 wherein the spindle has a substantially round cross section, with said inner end having a square cross section.

7. The spanner as claimed in claim 1 wherein the second tube is kept in position by said stop means which is press fit with the half inch square driver.

8. The spanner as claimed in claim 3, wherein the spindle has a substantially round cross section, with said inner end having a square cross section.

9. The spanner as claimed in claim 4, wherein the spindle has a substantially round cross section, with said inner end having a square cross section.

10. The spanner as claimed in claim 5, wherein the spindle has a substantially round cross section, with said inner end having a square cross section.

* * * * *